US006155844A

United States Patent [19]

Semmeling et al.

[11] Patent Number: 6,155,844

[45] **Date of Patent: *Dec. 5, 2000**

[54] ELECTRICAL CONNECTOR FOR MOUNTING A PANEL-LIKE DEVICE ON A PRINTED BOARD

[75] Inventors: Ralph A. E. M. Semmeling; Andrew G. Meller, both of Vlijmen, Netherlands

[73] Assignee: Berg Technology, Inc., Reno, Nev.

[ * ] Notice: This patent issued on a continued prosecution application filed under 37 CFR 1.53(d), and is subject to the twenty year patent term provisions of 35 U.S.C. 154(a)(2).

[21] Appl. No.: 09/001,971

[22] Filed: Dec. 31, 1997

Related U.S. Application Data

[60] Provisional application No. 60/042,360, Mar. 26, 1997.

[51] Int. Cl.[7] ..... H01R 12/00

[52] U.S. Cl. ..... 439/65; 439/80

[58] Field of Search ..... 439/65, 79, 74, 439/80

[56] References Cited

U.S. PATENT DOCUMENTS

| | | | |
|---|---|---|---|
| 3,551,750 | 12/1970 | Sterling | 439/66 |
| 3,631,380 | 12/1971 | Bohn | 439/65 |
| 3,715,706 | 2/1973 | Michel et al. | 439/65 |
| 4,738,625 | 4/1988 | Burton et al. | 439/74 |
| 5,259,769 | 11/1993 | Cruise et al. | 439/65 |
| 5,588,844 | 12/1996 | Sipe | 439/74 |

OTHER PUBLICATIONS

Machinery's Handbook, 21st edition, Industrial Press, pp. 49, 430, 1979.

*Primary Examiner*—T. C. Patel

*Attorney, Agent, or Firm*—Brian J. Hamilla; M. Richard Page

[57] ABSTRACT

An electrical connector which includes an insulative body which has a leg portion and a top portion which extends generally perpendicularly from the leg second portion. A conductive contact which includes a retention section and a resilient section is also included in the electrical connector. The contact is fixed to the top section and the resilient section extends along the leg section. The connector may be interposed between a electrical device and a printed circuit board.

20 Claims, 7 Drawing Sheets

ELECTRICAL CONNECTOR FOR MOUNTING A PANEL-LIKE DEVICE ON A PRINTED BOARD

This application claims benefit of provisional application 60/042360, filed Mar. 26, 1997.

BACKGROUND OF THE INVENTION

1. Field of the Invention

This invention relates to electrical connectors and particularly to printed circuit board connectors.

2. Brief Description of Prior Developments

Electrical connectors for connecting small panel-like electrical devices, such as circuit boards or liquid crystal displays (LCD) to another circuit board are known. One such connector employs an insulative body having a slot for receiving an LCD module. A linear array of connector terminals are mounted on the body. The spring portions disposed at one end of the terminals are located along the slot to engage circuit contact pads on the LCD. The other ends of the terminals are wrapped about the connector body and extend in a fixed position along a bottom edge of the connector body to form bottom contacts. Because the bottom contacts have no compliance, it is necessary to utilize a sheet of elastomeric material between the bottom of the connector body and the circuit board. The elastomeric body is provided with appropriate conductive traces to electrically connect the bottom contacts with appropriate contacts on the printed circuit board. The connector is held compressed against the elastomeric material by a compressive force, typically generated by the portion of the housing in which the LCD is mounted. It is common to apply an adhesive to hold the connector secure onto the LCD. The use of conductive elastomers and adhesives adversely affects the ease and cost of manufacturing devices, such as portable hand held electronic devices that have visual displays, such as cellular telephones.

SUMMARY OF THE INVENTION

The electrical connector of the present invention includes an insulative body comprising a first portion and a second portion extending generally perpendicularly from the first second portion. The connector also includes a conductive means comprising a retention section and a resilient section. The conductive means is retained by the second portion of the insulative body and the resilient section extending adjacent the first portion of the insulative body. The connector may be interposed between a planar electrical device and a printed circuit board.

BRIEF DESCRIPTION OF THE DRAWINGS

The electrical connector of the present invention is further described with reference to the accompanying drawings in which.

DETAILED DESCRIPTION OF THE PREFERRED EMBODIMENTS

The invention will be described in the context of a connector specifically adapted for electrically connecting planar electrical devices, such as LCD's, to another circuit board. However, the invention is believed to have applicability in other connectors.

Figure 1:
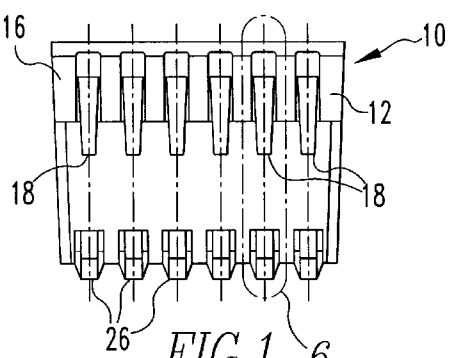
FIG. 1 is a front elevational view of a connector embodying the invention.
Figure 2:
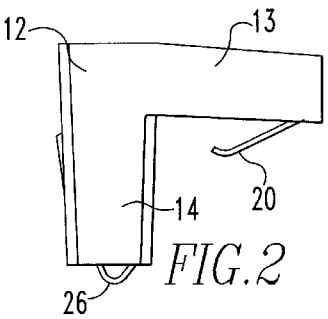
FIG. 2 is a side elevational view of the connector shown in FIG. 1.
Figure 3:
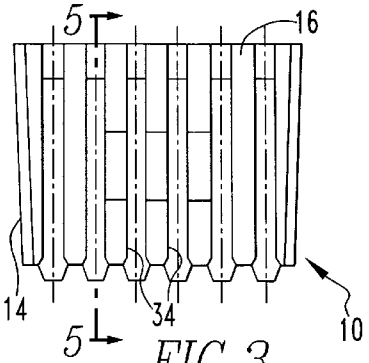
FIG. 3 is a back elevational view of the connector shown in FIG. 1.
Figure 4:
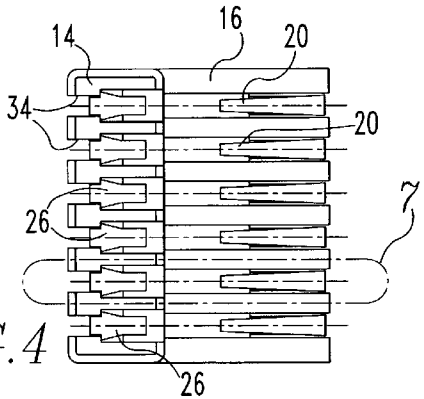
FIG. 4 is a bottom view of the connector shown in FIG. 1.

FIG. 1 shows a connector 10 having a body 12 formed of a molded polymeric insulating material. The body 12 includes a vertically extending leg portion 14 and a generally horizontally extending top portion 16. The connector also includes a plurality of suitable conductive metal terminals 18, preferably formed by stamping.

Figure 5:
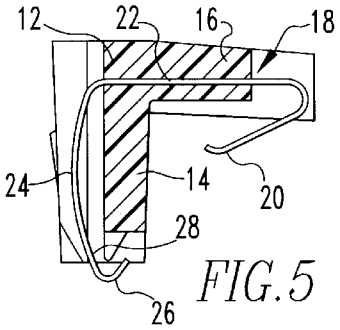
FIG. 5 is a cross-sectional view taken along line AA of FIG. 3.
Figure 6:
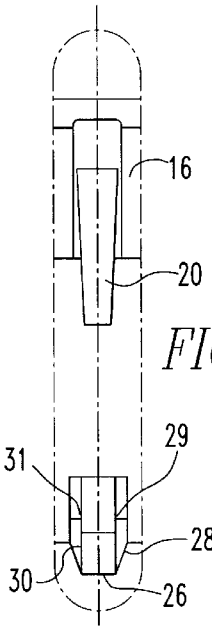
FIG. 6 is an enlarged view of area B of FIG. 1.
Figure 7:
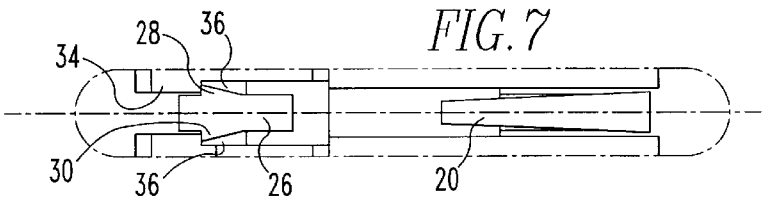
FIG. 7 is an enlarged view of area C of FIG. 4.

Each terminal 18 includes a cantilevered spring contact portion 20 for engaging an electrical device, as will later be described. Terminals 18 further include a retention portion 22 (FIG. 5), where the terminal 18 is retained in the body 12. Each terminal further includes a downwardly extending resilient beam portion 24 extending along the rear of the body 12. At the bottom of each terminal 18 is a PCB contact portion 26 for engaging contact pads on a printed circuit board, as will later be explained. As can be seen in FIG. 5, the PCB contact section 26 is formed as a curved surface having an outside radius that contacts the printed circuit board. Adjacent the contact portion 26 is an opposed pair of retention ears 28 and 30 (FIG. 7), the upper portions 29 and 31 (FIG. 6) of which are bent inwardly to form radiused surfaces, such as surface 32 (FIG. 8*d*).

As shown in FIGS. 3, 4 and 8*a*–*f*, grooves 34 are formed in the back of the housing 12 for receiving the portions 24 of beams 18. Additionally, undercut portions 36 are formed in opposing relationship in each groove 34. The undercut portions 36 form shoulder surfaces 38 that are designed to engage the surfaces 32 of terminal 18, as will later be described.

Figure 8A:
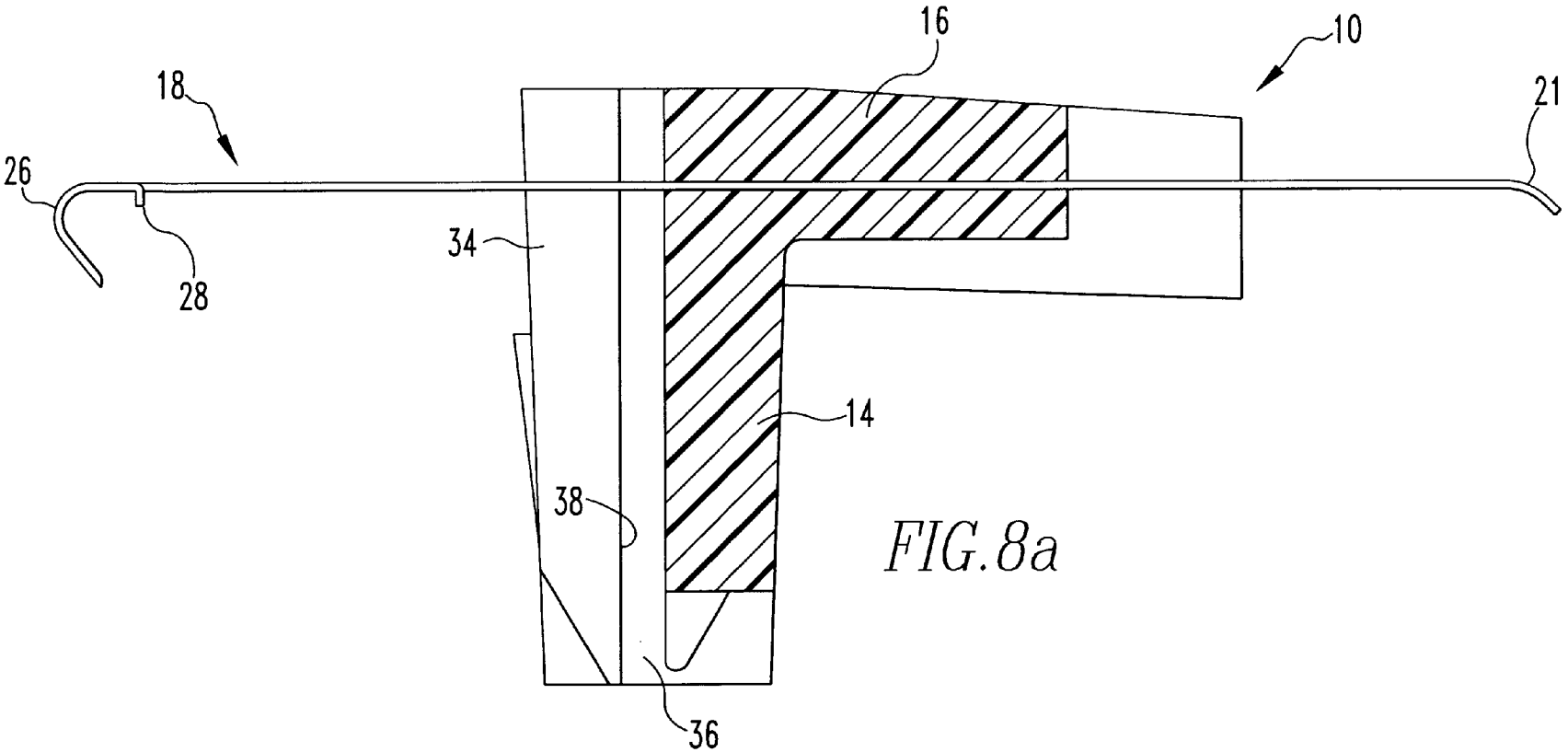
FIGS. 8*a*–8*f* are sequential illustrations of manufacturing and installation steps related to the connector of FIG. 1.

In FIG. 8*a*, the connector 10 is shown in a intermediate stage of manufacture. In this stage, an array of terminals 18 in coplanar, side-by-side relationship may be formed by stamping from terminal sheet stock. As shown in the figure, the ends of the terminals 18 have been preliminarily bent to form the contact portion 21 of the cantilevered spring arm 20 and the printed circuit board contact portion 26. The connector body 12 is preferably formed by overmolding or insert molding the connector body 12 onto the array of terminals 18, so that the terminals are securely held in the body 12.

Figure 8B:
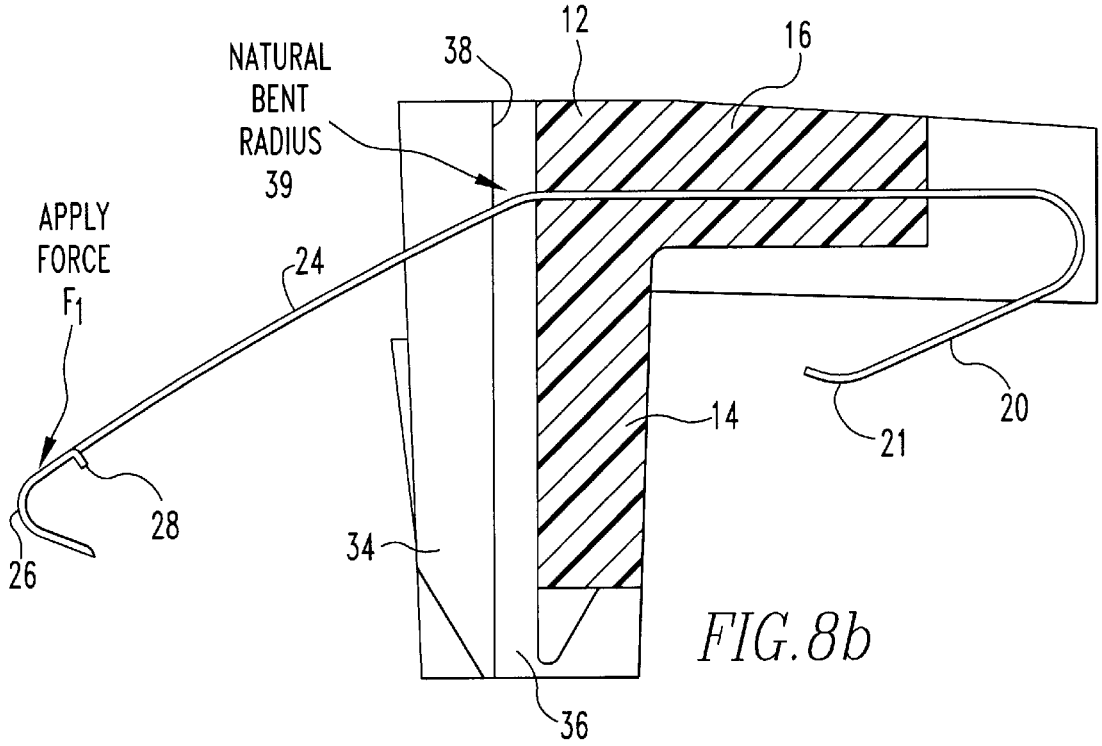
Figure 8D:
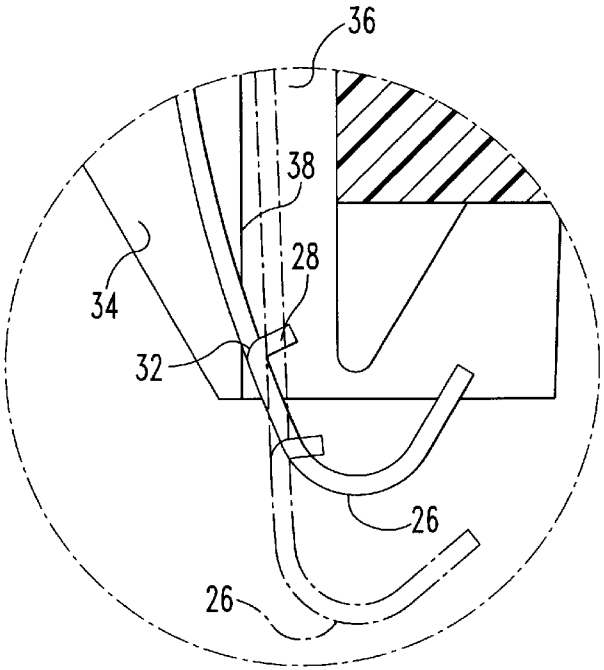
Figure 8C:
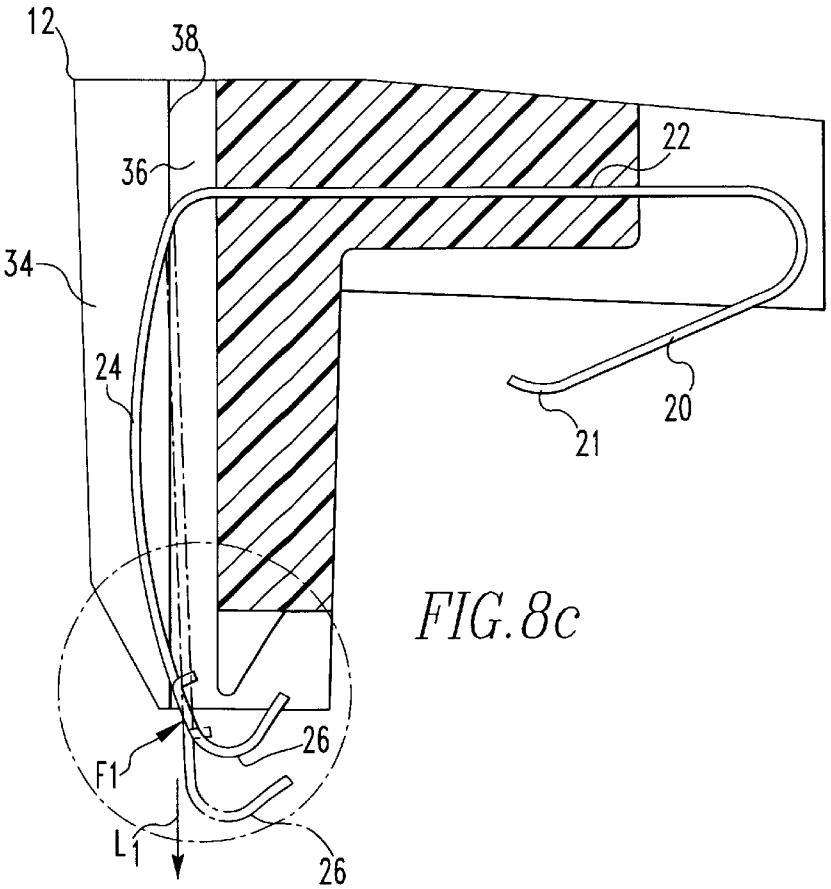

Referring to FIG. 8*b*, the cantilevered spring portion 20 has been formed by bending. Also, the beam portion 24 is formed by applying a force in the direction of arrow Fl at or near the tip of the section 24 to bend the section 24 about a bend radius formed generally in the area of region 39. Eventually, the beam portion 24 is bent toward the full line portion shown in FIG. 8*c*. At this time, force F1 is maintained on the end of the beam 24. At the same time, a force F2 is applied to the mid-section of the beam to extend the length of the beam to position the tip section 26 toward the dotted line position shown in FIGS. 8*c* and 8*d*. At this time, the surface 32 of each of the ears 28, 30 is positioned in general alignment with the shoulder surfaces 38. After the force F2 is removed, the beam retracts so that the surfaces 32 of the ears 28, 30 are retained against the shoulder surfaces 38. In this manner, the portion 26 is located and a desired amount of preload is imparted on it.

When a force the direction of arrow F2 is applied, the beam lengthens in the direction of arrow Ll. Conversely, when the force F2 is removed, the spring force in the beam returns the beam to its original shape, thereby shortening the length of the beam and raising the contact section 26 toward the connector body 12.

Figure 8E:
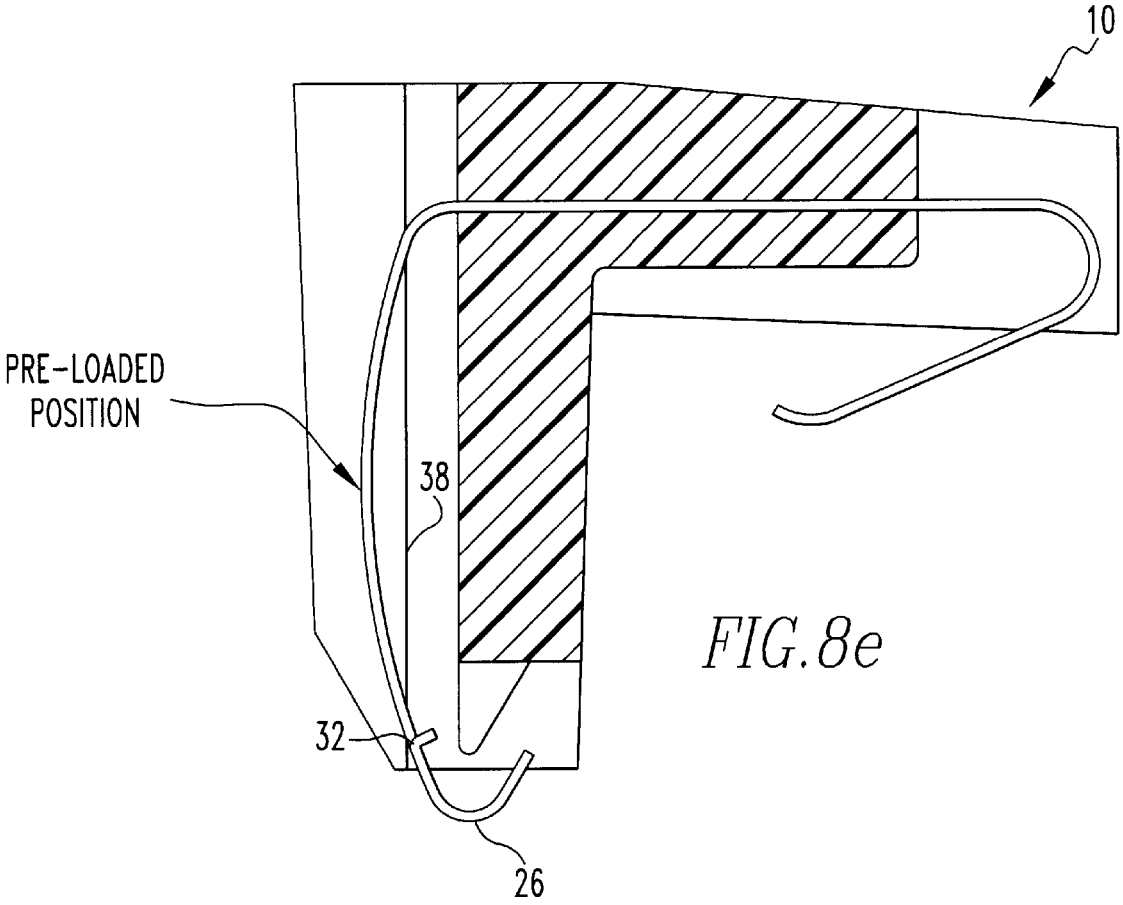
Figure 8F:
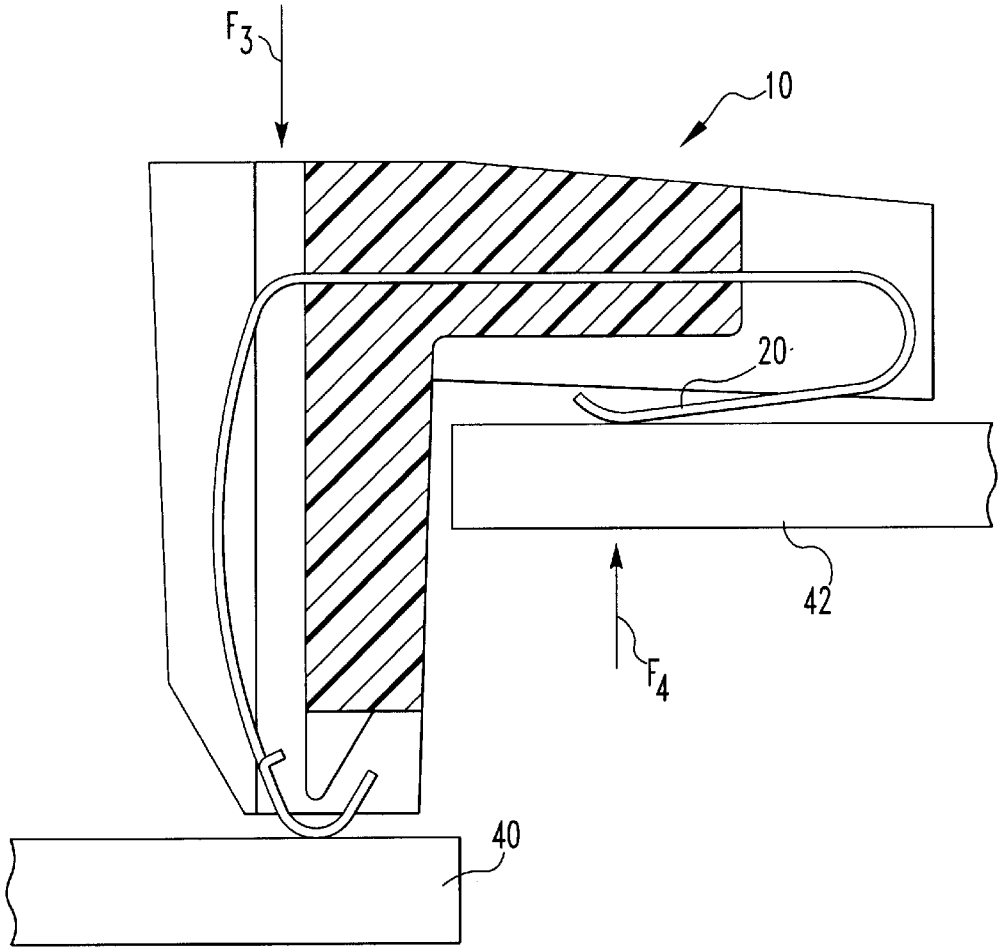

FIG. 8*e* shows the connector 10 substantially in a rest position, with the printed circuit board contact portion 26 extending beneath the housing. FIG. 8*f* shows the connector in mated condition, wherein a force in the direction of arrow F3 holds the connector 10 against the substrate 40 causing the beam 24 to be buckled. The resulting deflection generates a normal force pressing contact portion 26 against PCB 40. In addition, a force applied in the direction of arrow F4 to the LCD 42 causes the contact section 20 to deflect, thereby generating a normal force pressing contact portion 21 against LCD 42.

Figure 9A:
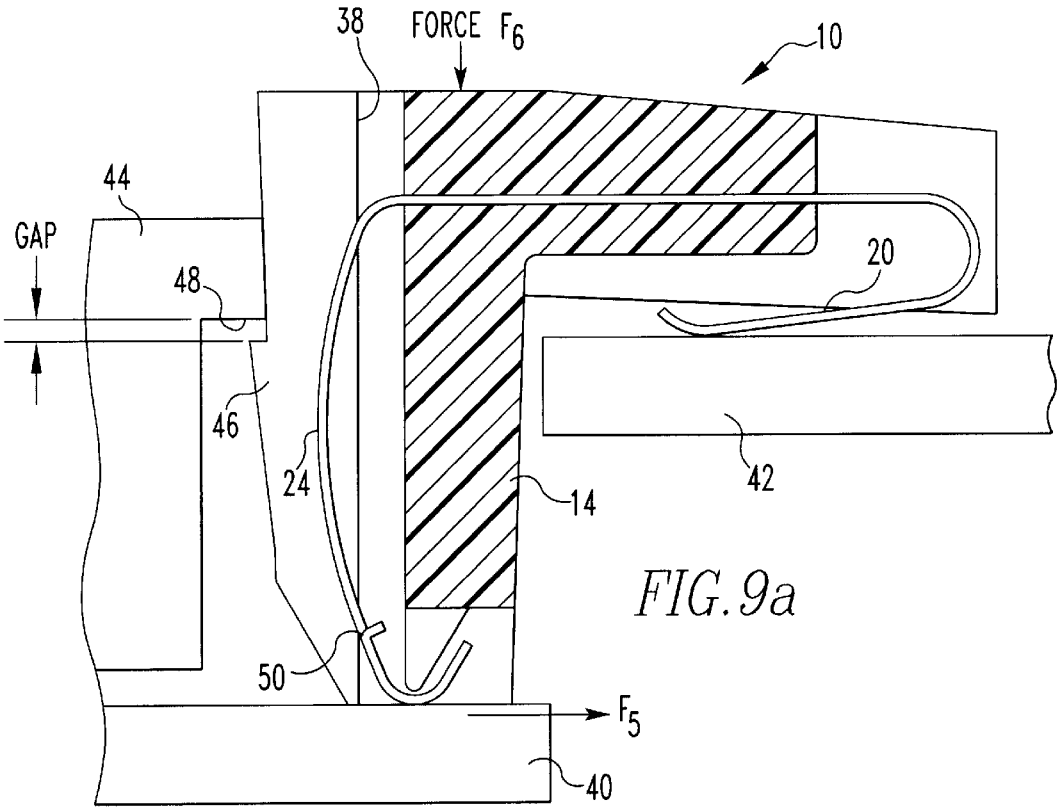
FIGS. 9*a* and 9*b* show positions of the connector of FIG. 1 during application and use.
Figure 9B:
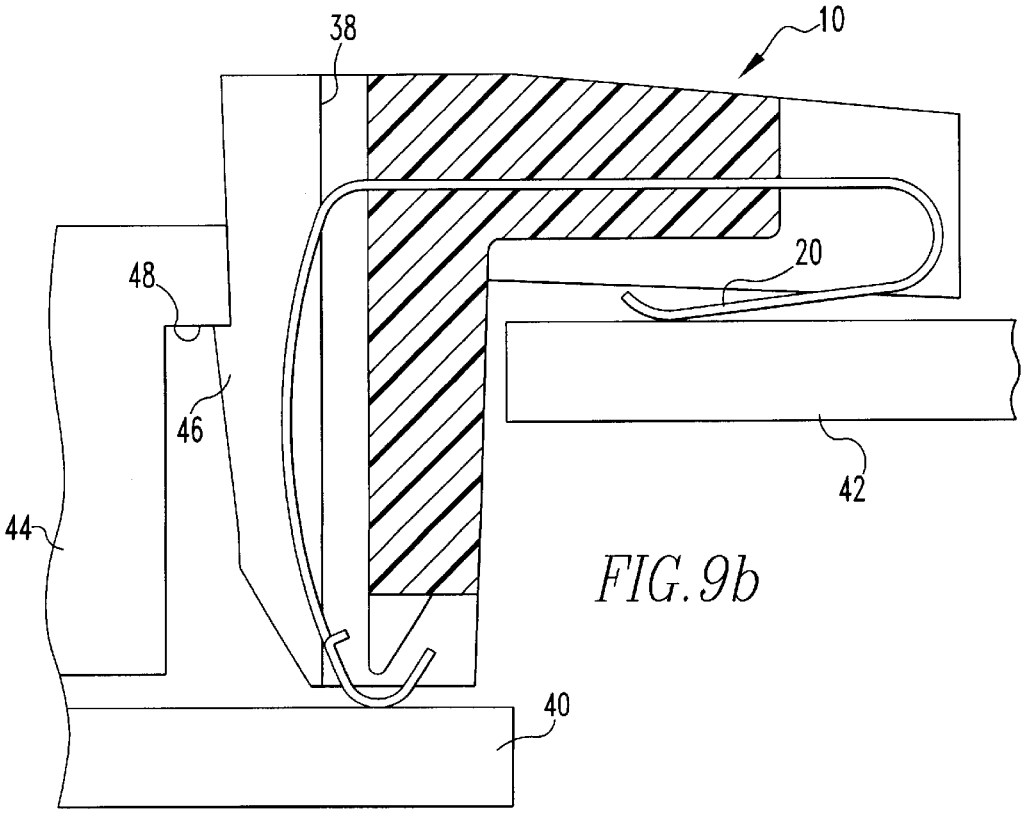

As shown in FIG. 9*a*, in a typical application, a frame 44 is provided to support the LCD 42 and the connector 10. In this arrangement, the LCD 42 is supported on portions (not shown) of the frame 44 and the connector 10 is inserted into the frame 44 by pushing the leg 14 of the connector through an aperture or recess in the frame 44. To accomplish this, a force in the direction of arrow F6 is placed on the connector 10 to insert the connector into the frame. In doing so, a retention tang 46 formed on the back of the connector body 12 is forced past the retention edge 48 of the opening. In this condition, the cantilevered beam contact 20 and the buckling beam 24 are deflected to a maximum extent, as the bottom edge of the connector is pressed against the surface of the printed circuit board 40. This figure also illustrates the action of the connector if, after assembly, a downward force is applied to the connector/LCD assembly, as by pressing downwardly on the LCD. An advantage of this construction is that the electrical connection at the level of contact portion 26 is maintained, even though a relatively high compressive force is repeatedly applied to connector 10. FIG. 9*b* shows the final mated position of the connector 10 wherein the retention tang 46 is retained against the surface 48 and the connector 10 has moved upward slightly away from the PCB 40, as a result of the spring force in beam 24.

It is to be further noted that the printed circuit board contact portion 26 undergoes a wiping and rolling action during this operation, to effect proper electrical connection with contact pads on PCB 40. This occurs as a result of the imposition of a vertical force on the beam section 24, which causes the section 26 to move along the surface of PCB 40 in the direction of arrow F5 (FIG. 9*a*). As this occurs, the contact portion 26 also rotates about a contact point between radius 32 and shoulder surface 38.

The connector disclosed has many advantages. The arrangement provides a relatively long spring travel using only a small area of the footprint of the connector. It also provides simplified locating and pre-loading of the contact portion 26. It further allows a contact wiping and cleaning action, thereby providing good contact. Further, this approach eliminates the need for conductive elastomeric members between the connector and the PCB.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. An electrical connector comprising:

(a) an insulative body comprising:

a first rear portion; and a second upper portion extending generally perpendicularly from the first rear portion; and (b) at least one contact comprising:

a top portion with a cantilevered forward spring extension adapted to engage a first mating component; and a resilient section adapted to engage a second mating component;

wherein said top portion is retained by the second upper portion of the insulative body so that the second upper portion extends above the top portion, the resilient section extends adjacent the first rear portion of the insulative body and has a distal end region retained by the first rear portion of the insulative body, such that, when the resilient section engages the second mating component, a force applied downwardly on the second upper portion of the insulative body causes the resilient section of the contact to flex.

2. The electrical connector of claim 1 wherein the at least one contact comprises a plurality of spaced metal terminals.

3. The electrical connector of claim 2 wherein the terminals are stamped metal terminals.

4. The electrical connector of claim 2 wherein each of the terminals include a retention section for securing the terminal to the insulative body.

5. The electrical connector of claim 1 wherein the first rear portion has a rear side and the resilient section of the contact extends along said rear side of the first rear portion.

6. The electrical connector of claim 2 wherein each of said plurality of terminals is retained in a respective one of a plurality of grooves in the insulative body.

7. The electrical connector of claim 1 wherein the resilient section of the contact has a terminal contact portion.

8. The electrical connector of claim 6 wherein each resilient section of the terminals has a lower terminal contact portion formed as a curved surface.

9. The electrical connector of claim 6 wherein each resilient section of the terminals has a retention section adjacent a lower terminal contact portion.

10. The electrical connector of claim 6 wherein each of the terminals include a retention section which includes a cantilevered spring contact.

11. The electrical connector of claim 10 wherein the cantilevered spring contact extends downwardly and rearwardly toward the first rear portion of the insulative body.

12. The electrical connector of claim 10 wherein each resilient section of the terminals is adapted to engage a printed circuit board.

13. The electrical connector of claim 12 wherein each retention section of the terminals is adapted to engage a planar electrical device.

14. The electrical connector of claim 13 wherein the planar electrical device is a liquid crystal display.

15. The electrical connector of claim 1 wherein the resilient section of the contact generally forms a buckled beam structure.

16. The electrical connector of claim 1 wherein the resilient section of the contact changes length as it buckles.

17. The electrical connector as recited in claim 1, wherein said insulative body is overmolded around said contact.

18. The electrical connector as recited in claim 1, wherein said top portion of said contact extends through an interior of said second upper portion of said insulative body.

19. An assembly comprising:

(a) a printed circuit board;

(b) a planar electrical device positioned in spaced generally parallel arrangement from the printed circuit board;

(c) an electrical connector comprising:

(i) an insulative body comprising a leg portion transverse to said printed circuit board and having a rear side with a tang extending transversely from the leg portion and adjacent the printed circuit board, and a top portion extending from said leg portion in generally parallel relation to said planar electrical device, and (ii) a contact comprising a top section movably retained by the top portion of the insulative body and having a cantilevered forward spring extension interposed between the top portion of the insulative body and the planar electrical device and a resilient section extending along the rear side of the leg portion of the insulative body and having a terminal contact portion interposed between said leg portion and the printed circuit board; and (d) a rear frame having a face in opposed spaced relation to the rear side of the insulative body and a ledge extending transversely to the face and toward the rear side of the insulative body so as to be superimposed over the tang thereof, such that a force applied downwardly on the top portion of the insulative body flexes the resilient section of the contact so that said ledge is spaced from said tang, and the release of said force allows the resilient section of the contact to move said tang into abutting relation with the said ledge.

20. The assembly claim 19 which further comprises a frame member which engages the rear side of the leg portion of the insulative body.

* * * * *